US011348562B2

(12) United States Patent
Nagasawa et al.

(10) Patent No.: US 11,348,562 B2
(45) Date of Patent: May 31, 2022

(54) ACOUSTIC DEVICE AND ACOUSTIC CONTROL PROGRAM

(71) Applicant: Yamaha Corporation, Hamamatsu (JP)

(72) Inventors: Tetsuya Nagasawa, Nagoya (JP); Petr Choulik, Hamamatsu (JP); Kazuhiro Tani, Hamamatsu (JP); Yu Inoue, Hamamatsu (JP); Shinichi Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 96 days.

(21) Appl. No.: 16/859,599

(22) Filed: Apr. 27, 2020

(65) Prior Publication Data

US 2020/0258487 A1 Aug. 13, 2020

Related U.S. Application Data

(63) Continuation of application No. PCT/JP2018/041138, filed on Nov. 6, 2018.

(30) Foreign Application Priority Data

Nov. 7, 2017 (JP) ..... JP2017-214943

(51) Int. Cl.
*G10H 1/053* (2006.01)
*G10H 1/00* (2006.01)
*G10H 3/18* (2006.01)

(52) U.S. Cl.
CPC ..... *G10H 1/053* (2013.01); *G10H 1/0008* (2013.01); *G10H 3/186* (2013.01);
(Continued)

(58) Field of Classification Search
CPC ..... G10H 1/053; G10H 1/0008; G10H 3/186; G10H 2210/066; G10H 2210/195; G10H 2210/265; G10H 2210/325
(Continued)

(56) References Cited

U.S. PATENT DOCUMENTS 5,121,669 A * 6/1992 Iba ..... G10H 1/0091 84/622
6,479,740 B1 * 11/2002 Schwartz ..... G10H 1/0091 84/605

(Continued)

FOREIGN PATENT DOCUMENTS

EP 1385146 A1 * 1/2004 ..... G10H 1/0091
JP 6-12072 A 1/1994
WO WO-9604642 A1 * 2/1996 ..... G10H 3/188

OTHER PUBLICATIONS

Supplementary European Search Report issued in European Application No. 18876387.4 dated Jun. 24, 2021 (ten (10) pages).

(Continued)

*Primary Examiner* — Christina M Schreiber
(74) *Attorney, Agent, or Firm* — Crowell & Moring LLP

(57) ABSTRACT

An acoustic device includes an audio recording playback unit, an analysis unit, and an acoustic effect imparting unit. The audio recording playback unit records and plays back string independent acoustic signals for each string independent acoustic signal. The string independent acoustic signals respectively correspond to different strings of a stringed instrument and being independent from each other. The analysis unit analyzes at least one string independent acoustic signal from among the recorded string independent acoustic signals. The acoustic effect imparting unit imparts an acoustic effect to the at least one string independent acoustic signal for each string independent acoustic signal, based on a result of the analysis by the analysis unit.

11 Claims, 6 Drawing Sheets

(52) U.S. Cl.
CPC ..... *G10H 2210/066* (2013.01); *G10H 2210/195* (2013.01); *G10H 2210/265* (2013.01); *G10H 2210/325* (2013.01)

(58) Field of Classification Search
USPC ..... 84/626
See application file for complete search history.

(56) References Cited

U.S. PATENT DOCUMENTS 7,598,450 B2 * 10/2009 Meeks ..... G10H 1/342 84/285
8,058,545 B2 * 11/2011 Yamada ..... G10H 3/186 84/618
8,735,710 B2 * 5/2014 Yamabata ..... G10H 3/26 84/627
10,019,980 B1 * 7/2018 Abel ..... G10K 15/12
2006/0064186 A1 * 3/2006 Ryle ..... G10H 1/0091 700/94
2008/0047414 A1 * 2/2008 Friedman ..... G10H 1/44 84/609
2008/0257136 A1 * 10/2008 Meeks ..... G10H 1/342 84/727
2009/0229448 A1 * 9/2009 Yamada ..... G10H 3/186 84/612
2010/0313740 A1 * 12/2010 Ryle ..... G10H 1/125 84/735
2012/0255419 A1 * 10/2012 Lucas ..... G10D 3/053 84/318
2020/0258487 A1 * 8/2020 Nagasawa ..... G10H 1/383
2021/0264885 A1 * 8/2021 Black ..... G10D 3/153

OTHER PUBLICATIONS

International Search Report (PCT/ISA/210) issued in PCT Application No. PCT/JP2018/041138 dated Jan. 29, 2019 with English translation (three (3) pages).

* cited by examiner

| | | STRING ID NUMBER | | | | | |
|---|---|---|---|---|---|---|---|
| | | 1 | 2 | 3 | 4 | 5 | 6 |
| RECORDING ID NUMBER | 1 | ... | ... | ... | ... | ... | ... |
| | 2 | ... | ... | ... | ... | ... | ... |
| | 3 | ... | ... | ... | ... | ... | ... |
| | 4 | ... | ... | ... | ... | ... | ... |
| | 5 | ... | ... | ... | ... | ... | ... |

ACOUSTIC DEVICE AND ACOUSTIC CONTROL PROGRAM

CROSS-REFERENCE TO RELATED APPLICATIONS

The present application is a continuation application of International Application No. PCT/JP2018/041138, filed Nov. 6, 2018, which claims priority to Japanese Patent Application No. 2017-214943, filed Nov. 7, 2017. The contents of these applications are incorporated herein by reference.

BACKGROUND OF THE INVENTION

Field of the Invention

The embodiments of the present invention relate to an acoustic device for a stringed instrument and an acoustic control program for operating a computer as an acoustic device.

Description of Related Art

An electric guitar is an example of a stringed instrument. This electric guitar may be provided with a pickup (for example, a divided pickup) capable of acquiring vibrations of a plurality of strings as independent acoustic signals for each string. For each string, different acoustic effects can be added to the acoustic signals of the strings obtained by the pickups. According to such a stringed instrument, different acoustic effects can be obtained independently for each string.

The electric guitar can, for each string, switch the acoustic effect imparted to the acoustic signal of a string in accordance with pitch information of the acoustic signal of the string.

SUMMARY OF THE INVENTION

However, the existing electric guitar switches acoustic effects by real-time processing from the acoustic signals of the strings acquired by the pickup. Therefore, it is difficult for the existing electric guitar to secure sufficient time for analyzing the acoustic signals of the strings. In addition, the acoustic effects to be added to the acoustic signals of the strings are limited to those that can be processed in real time.

The embodiments of the present invention have been made in view of the above circumstances. An example of an object of the present invention is to provide an acoustic device and an acoustic control program capable of recording and playing back a string acoustic signal for each string, and capable of analyzing the string acoustic signal and imparting an acoustic effect to the string acoustic signal by non-real-time processing.

An acoustic device according to an aspect of the present invention includes: an audio recording playback unit that records and plays back string independent acoustic signals for each string independent acoustic signal, the string independent acoustic signals respectively corresponding to different strings of a stringed instrument and being independent from each other; an analysis unit that analyzes at least one string independent acoustic signal from among the recorded string independent acoustic signals; and an acoustic effect imparting unit that imparts an acoustic effect to the at least one string independent acoustic signal for each string independent acoustic signal, based on a result of the analysis by the analysis unit.

An acoustic control program according to an aspect of the present invention causes a computer to execute: recording and playing back string independent acoustic signals for each string independent acoustic signal, the string independent acoustic signals respectively corresponding to different strings of a stringed instrument and being independent from each other; analyzing at least one string independent acoustic signal from among the recorded string independent acoustic signals; and imparting an acoustic effect to the at least one string independent acoustic signal for each string independent acoustic signal, based on a result of the analysis.

An acoustic control method according to an aspect of the present invention includes: recording and playing back string independent acoustic signals for each string independent acoustic signal, the string independent acoustic signals respectively corresponding to different strings of a stringed instrument and being independent from each other; analyzing at least one string independent acoustic signal from among the recorded string independent acoustic signals; and imparting an acoustic effect to the at least one string independent acoustic signal for each string independent acoustic signal, based on a result of the analysis.

Other objects, advantages and novel features of the embodiments of present invention will become apparent from the following detailed description of one or more preferred embodiments when considered in conjunction with the accompanying drawings, in which:

DETAILED DESCRIPTION OF EMBODIMENTS

Figure 1:
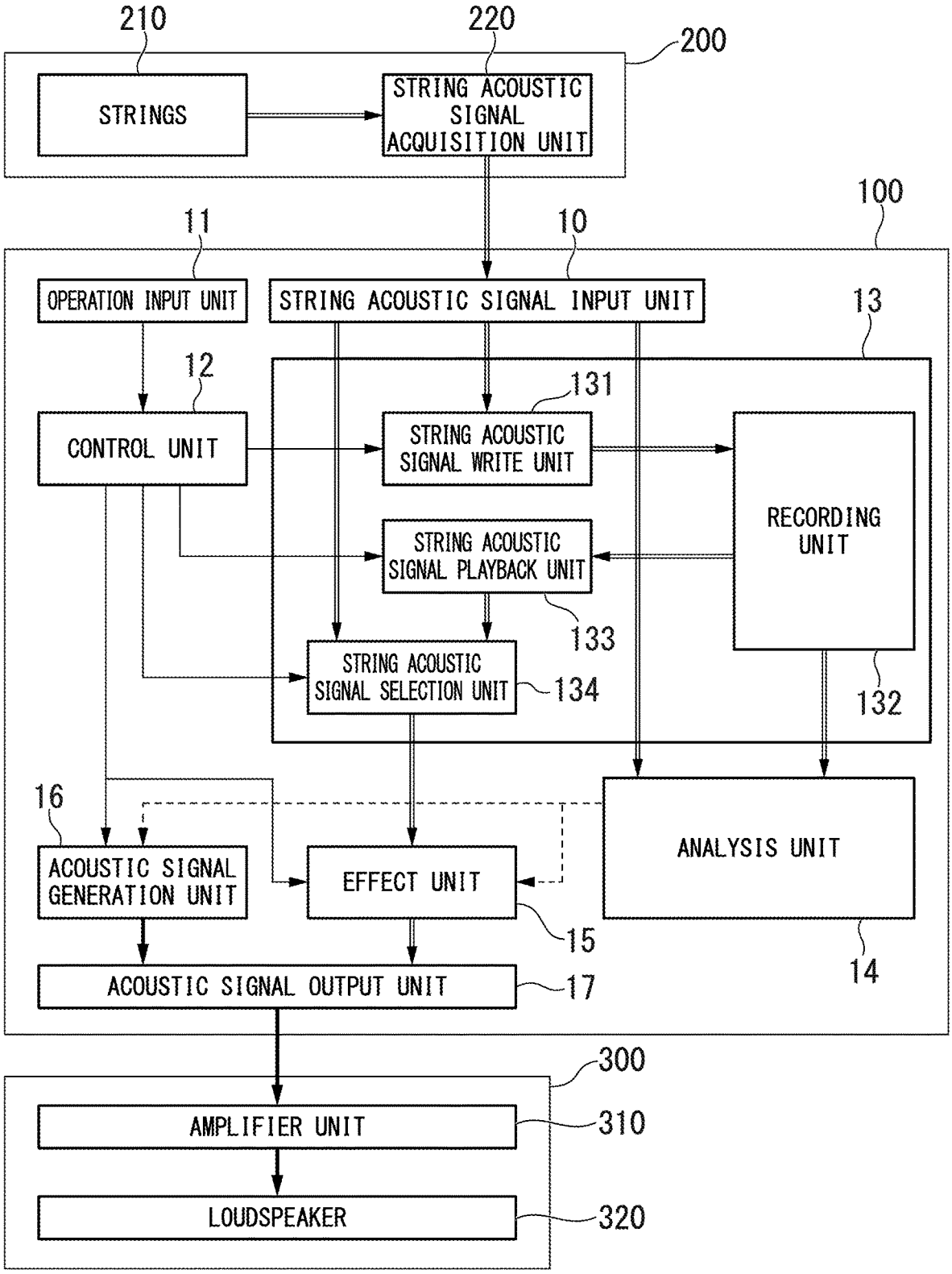
FIG. 1 is a block diagram showing an acoustic device according to an embodiment of the present invention.

Hereinafter, an acoustic device 100 according to an embodiment of the present invention will be described with reference to FIGS. 1 to 9. FIG. 1 is a block diagram showing the acoustic device 100, an electric guitar (stringed instrument) 200, and an acoustic output device 300. The electric guitar 200 and the acoustic output device 300 are used together with the acoustic device 100. The acoustic device 100 receives an acoustic signal output from the electric guitar 200. The acoustic device 100 analyzes the acoustic signal and imparts an acoustic effect to the acoustic signal, and outputs the acoustic signal to which the acoustic effect has been imparted to the acoustic output device 300.

As shown in FIG. 1, the acoustic device 100 includes a string acoustic signal input unit 10, an operation input unit 11, a control unit 12, an audio recording playback unit 13, an analysis unit 14, an effect unit (acoustic effect imparting unit) 15, an acoustic signal generation unit 16, and an acoustic signal output unit 17.

The electric guitar 200 includes six strings 210 and a string acoustic signal acquisition unit 220. The string acoustic signal acquisition unit 220 is, for example, a divided pickup that can separate and acquire an acoustic signal for each string 210. The string acoustic signal acquisition unit 220 converts vibrations of the strings 210 into acoustic signals for each of the strings 210, and outputs a plurality of acoustic signals independent for each of the strings 210 (hereinafter, "six-string independent acoustic signals (each string-independent acoustic signal)"). In FIG. 1, double-line arrows indicate that the acoustic signals are six-string independent acoustic signals.

The acoustic output device 300 includes an amplifier unit 310 and a loudspeaker 320, as shown in FIG. 1. The amplifier unit 310 amplifies an acoustic signal output from the acoustic device 100. The loudspeaker 320 emits the amplified acoustic signal. Note that, in FIG. 1, thick-line arrows indicate an acoustic signal different from the six-string independent acoustic signals, that is, an acoustic signal obtained by integrating the acoustic signals of the six strings 210.

The string acoustic signal input unit 10 acquires the six-string independent acoustic signals output by the electric guitar 200. The string acoustic signal input unit 10 includes an A/D conversion unit which converts an analog acoustic signal obtained from the electric guitar 200 into a digital signal. When the acoustic signal acquired from the electric guitar 200 is a digital signal, the conversion processing by the A/D conversion unit is unnecessary.

The string acoustic signal input unit 10 outputs the acquired six-string independent acoustic signals to the audio recording playback unit 13 (the string acoustic signal write unit 131 and string acoustic signal selection unit 134) and the analysis unit 14.

The operation input unit 11 is an input device that is constituted by a touch panel, a switch, a foot pedal, and the like, and that receives an operation input from a player. When the operation input unit 11 is a touch panel, the touch panel may be mounted on the body of the electric guitar 200. The operation input unit 11 may be constituted by combining input devices such as a touch panel and a foot pedal.

The player can input a recording instruction, a playback instruction, an effect instruction, and a sound generation instruction to the acoustic device 100 by operating the operation input unit 11. The instruction from the player input to the operation input unit 11 is transferred to the control unit 12.

The recording instruction is an instruction for requesting the start and stop of recording of the six-string independent acoustic signals. A recording instruction can be given for each string. For example, the recording instruction may be an instruction to record the acoustic signals of all six strings, or may be an instruction to record only an acoustic signal of a specific string. For example, when the operation input unit 11 includes a foot pedal, the player may instruct the start of recording and the stop of recording by operating the foot pedal.

The playback instruction is an instruction for requesting playback of an acoustic signal recorded by the recording unit 132. A playback instruction can also be given for each string. For example, the playback instruction may be an instruction to play back the acoustic signals of all six strings, or may be an instruction to play back only the acoustic signal of a specific string. The playback instruction may be an instruction to play back a recorded acoustic signal only once, or may be an instruction to repeatedly play back a recorded acoustic signal (loop playback).

The effect instruction is an instruction regarding the presence/absence, type, and parameter of an acoustic effect to be imparted to the six-string independent acoustic signals. An effect instruction can also be given for each string. For example, the effect instruction may be an instruction to enable effect processing for all the acoustic signals of the six strings, or may be an instruction to enable effect processing only for the acoustic signal of a specific string. For example, when the operation input unit 11 includes a touch panel, a parameter of an acoustic effect may be changed in accordance with an operation of changing the position of a finger in contact with the touch panel by sliding.

The sound generation instruction is an instruction for automatically generating an acoustic signal of a musical instrument (drum set, guitar, bass guitar, or the like) to be superimposed on the acoustic signal of the electric guitar 200. In accordance with the sound generation instruction, the acoustic signal of a musical instrument such as a drum set is superimposed in a manner matching the performance of the player of the electric guitar 200. As a result, the player can enjoy a performance resembling an ensemble performance.

The control unit 12 controls the audio recording playback unit 13, the analysis unit 14, the effect unit 15, and the acoustic signal generation unit 16 on the basis of an instruction from the player input to the operation input unit 11. Note that, in FIG. 1, thin-line arrows indicate control signals from the control unit.

The audio recording playback unit 13 includes a string acoustic signal write unit 131, an recording unit 132, a string acoustic signal playback unit 133, and a string acoustic signal selection unit 134. The audio recording playback unit 13 can record and play back an input acoustic signal. The audio recording playback unit 13 functions as a "looper" that performs recording and playback on the basis of an instruction from the player input to the operation input unit 11. The player can use the function of the looper for uses such recording his/her own performance, playing back the recorded performance in a loop, and further superimposing his/her own performance on the performance during the loop playback. The audio recording playback unit 13 can record and play back an acoustic signal for each string.

The string acoustic signal write unit 131 receives an input of six-string independent acoustic signals from the acoustic signal input unit 10. On the basis of the control signal from the control unit 12 that has received a recording instruction, the string acoustic signal write unit 131 transfers an acoustic signal that is the recording object during a period from recording start to recording stop, of the six-string independent acoustic signals that have been input, to the recording unit 132 as independent acoustic signals for each string. When the recording instruction is an instruction to record only the acoustic signal of a specific string, only the acoustic signal acquired from that specific string is transferred to the recording unit 132.

The string acoustic signal write unit 131 imparts to the acoustic signal that is the recording object to be transferred an ID number (hereinafter referred to as a "string ID number") that can specify from which of the six strings 210 the acoustic signal has been acquired, among the six strings 210.

For example, when the recording instruction is an instruction to record the sounds of two strings, that is, the sixth string and the fifth string, the string acoustic signal write unit 131 transfers to the recording unit 132 the acoustic signals of the sixth and fifth strings, which are the objects of recording in the six-string independent acoustic signals. The string ID number "6" is imparted to the acoustic signal of the sixth string, and the string ID number "5" is imparted to the acoustic signal of the fifth string.

In addition, the string acoustic signal write unit 131 imparts, for each recording, a unique recording ID number to the acoustic signal of the object of recording to be transferred. The same recording ID number is imparted to acoustic signals of a plurality of strings recorded simultaneously.

The recording unit 132 includes a recording medium such as RAM, flash memory, and a hard disk, and is capable of recording acoustic signals that are digital signals as acoustic data. The recording medium provided in the recording unit 132 has a writing and reading speed that can sufficiently record and play back the acoustic signals of six strings simultaneously. The player can therefore record an acoustic signal within the recording capacity of the recording medium.

Figures 2, 3:
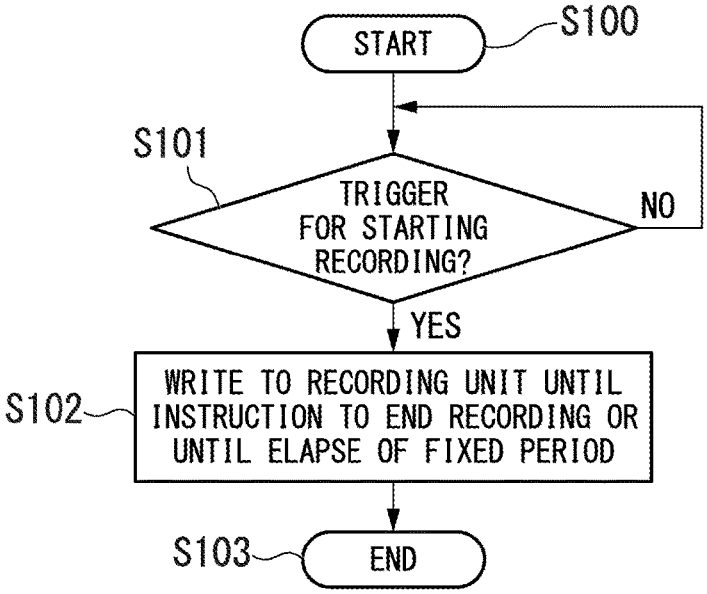
FIG. 2 is a diagram for describing acoustic data recorded in a recording unit of the acoustic device shown in FIG. 1.
FIG. 3 is a flowchart for describing the operation of the acoustic device shown in FIG. 1 when a recording instruction is given.

FIG. 2 is a diagram for illustrating acoustic data recorded in the recording unit 132. As shown in FIG. 2, the acoustic data is recorded in a data structure with a table format, and is stored in the recording unit 132 on the basis of the string ID number and the recording ID number. The acoustic data is recorded in a relevant part of the table, being the table column corresponding to the string ID number given to the acoustic signal of the object of recording, and the table row corresponding to the recording ID number.

For example, when an acoustic signal to which the string ID number "6" and the recording ID number "4" are assigned is transferred from the string acoustic signal write unit 131, the recording unit 132 stores the acoustic signal that has been transferred in the relevant part of the table, which is the table column "6" and the table row "4".

That is, it is possible to specify from which string of the six strings 210 an item of acoustic data recorded in the recording unit 132 has been acquired. Further, on the basis of the acoustic data recorded in the recording unit 132, it is possible to specify acoustic data acquired from another string recorded simultaneously with that acoustic data.

The string acoustic signal playback unit 133 reads acoustic data corresponding to the recording ID number and the string ID number of the object of playback on the basis of a control signal from the control unit 12 that has received a playback instruction. The string acoustic signal playback unit 133 outputs the read acoustic data to the string acoustic signal selection unit 134 as independent acoustic signals for each string. If the playback instruction is an instruction to play back only the acoustic signal of a specific string, only the acoustic signal corresponding to that specific string is read and output as an acoustic signal.

On the basis of the control signal from the control unit 12 that has received the playback instruction, the string acoustic signal selection unit 134 replaces the acoustic signal of the string for which a playback instruction was made, in the six-string independent acoustic signals input from the string acoustic signal input unit 10, with the acoustic signal transferred from the string acoustic signal playback unit 133. The string acoustic signal selection unit 134 outputs to the effect unit 15 the six-string independent acoustic signals, a part of which has been replaced with the transferred acoustic signal.

For example, when the playback instruction is an instruction to play back the two strings of the sixth string and the fifth string, the string acoustic signal selection unit 134 replaces the acoustic signals of the sixth string and fifth string in the six-string independent acoustic signals input from the string acoustic signal input unit 10 with the acoustic signals of the sixth string and fifth string transferred from the string acoustic signal playback unit 133. Replacement of the acoustic signals of the first to fourth strings is not performed.

Without performing the acoustic data replacement described above, the string acoustic signal selection unit 134 may superimpose the acoustic signal input from the string acoustic signal input unit 10 and the acoustic signal transferred from the string acoustic signal playback unit 133 for each string and output the superimposed acoustic signals as an acoustic signal. That is, the string acoustic signal selection unit 134 may output at least one of the acoustic signal input from the string acoustic signal input unit 10 and the acoustic signal (playback acoustic signal) transferred from the string acoustic signal playback unit 133.

The analysis unit 14 performs analysis by real-time processing of the six-string independent acoustic signals input from the string acoustic signal input unit 10 and analysis by non-real-time processing of the acoustic data recorded in the recording unit 132. The analysis performed by the analysis unit 14 includes, for example, chord analysis of an acoustic signal, attack detection, BPM (beats per minute) detection, and the like.

The analysis unit 14 can perform analysis by non-real-time processing on the acoustic data recorded in the recording unit 132. For this reason, compared with the case where only the analysis by real-time processing is performed, it is possible to secure sufficient time for performing analysis of the acoustic signal of a string.

The effect unit (acoustic effect imparting unit) 15 imparts an acoustic effect to the acoustic signal input from the string acoustic signal selection unit 134 on the basis of a control signal from the control unit 12 that has received an effect instruction and the analysis result of the analysis unit 14. The acoustic effect to be imparted is, for example, a reverse effect, a pitch shift effect, a delay effect, or the like.

The analysis unit 14 can analyze the acoustic data recorded in the recording unit 132 by non-real-time processing. For this reason, the effect unit 15, on the basis of that analysis result, can impart to an acoustic signal an acoustic effect that is not easy only with real-time analysis.

The effect unit 15 outputs acoustic signals to which the acoustic effect has been imparted to the acoustic signal output unit 17. The acoustic signals output from the effect unit 15 are six-string independent acoustic signals independent for each string. The effect unit 15 may output an acoustic signal obtained by integrating the acoustic signals of the six strings.

Alternatively, the following processing may be performed. That is, the analysis unit 14 performs analysis by non-real-time processing on an acoustic signal (acoustic data) recorded in the recording unit 132. The effect unit 15 applies an acoustic effect to the acoustic signal on the basis of the analysis result. The recording unit 132 overwrites the recorded acoustic signal on the acoustic signal to which the acoustic imparted has been given by the effect unit 15. The recording unit 132 may store the acoustic signal to which the acoustic effect has been imparted by the effect unit 15 in a location different from the storage location of the already recorded acoustic signal. The recording unit 132 supplies the overwritten acoustic signal to the string acoustic signal playback unit 133. In this case, an acoustic effect based on the analysis result by the non-real-time processing is already imparted to at least a part of the acoustic signal output from the string acoustic signal selection unit 134. Therefore, the effect unit 15 may omit part or all of the processing for imparting an acoustic effect to the acoustic signal output from the string acoustic signal selection unit 134.

The acoustic signal generation unit 16 generates an acoustic signal of a musical instrument (a drum set, guitar, bass guitar or the like) to be superimposed on the acoustic signal output from the effect unit 15, on the basis of a control signal from the control unit 12 that has received a sound generation instruction and the analysis result of the analysis unit 14. For example, a signal of a drum performance that matches the BPM analyzed by the analysis unit 14 may be generated as an acoustic signal. As an acoustic signal, a signal of a bass performance matching the chord progression detected by the analysis unit 14 may be generated. The generated acoustic signal is output to the acoustic signal output unit 17.

The acoustic signal output unit 17 mixes the six-string independent acoustic signals output from the effect unit 15 and the acoustic signal output from the acoustic signal generation unit 16 to generate an acoustic signal in which all acoustic signals are integrated. The generated acoustic signal is output to the acoustic output device 300.

In the acoustic device 100, the control unit 12, the audio recording playback unit 13, the analysis unit 14, the effect unit 15, the acoustic signal generation unit 16, and the acoustic signal output unit 17 are, for example, constituted by a processing device such as a CPU (central processing unit) or a dedicated electronic circuit.

These may also be configured by, for example, separate processing devices and electronic circuits, respectively. For example, at least some of them may be configured with a common processing device or electronic circuit.

Next, the operation of the acoustic device 100 will be described. FIG. 3 is a flowchart for describing the operation of the acoustic device 100 when a recording instruction is given.

First, when power is supplied to the acoustic device 100, the acoustic device 100 performs initial settings and enters a recording standby state (Step S100). The acoustic device 100 waits for a recording instruction to be input to the operation input unit 11, for example, a trigger operation for starting recording (Step S101). Here, the trigger operation of the recording start is an operation of depressing the foot pedal of the operation input unit 11, an operation of touching a predetermined position of the touch panel of the operation input unit 11, or the like.

If the recording instruction is an instruction to record only the acoustic signal of a specific string, the player specifies the string to be recorded via the operation input unit. For example, when the operation input unit 11 includes a plurality of foot pedals, the player may specify the string to be recorded by depressing the foot pedal corresponding to the string to be recorded. When the operation input unit 11 is constituted by a touch panel, the string to be recorded may be designated according to the place on the touch panel touched by the player.

When the player performs the trigger operation for starting recording, the acoustic device 100 starts the recording operation (Step S102). The control unit 12 transfers a control signal for starting recording to the string acoustic signal write unit 131 on the basis of the recording instruction from the player input to the operation input unit 11. When the recording instruction is an instruction to record only the acoustic signal of a specific string, the control unit 12 simultaneously transfers a control signal specifying the string to be recorded.

Here, the instruction to end the recording may be made by the player inputting a trigger operation to the operation input unit 11 in the same manner as the trigger operation to start the recording. The recording may be automatically ended when a predetermined recording period has elapsed from the start of the recording. Upon receiving an instruction to end the recording, the control unit 12 transfers the control signal indicating the end of the recording to the string acoustic signal write unit 131.

The string acoustic signal write unit 131 transfers to the recording unit 132, as acoustic signals independent for each string, the acoustic signals to be recorded during the period from the recording start to the recording stop from the six-string independent sound signals input from the string acoustic signal input unit 10. When the recording instruction is an instruction to record only the acoustic signal of a specific string, only the acoustic signal of that specific string is transferred to the recording unit 132.

The recording unit 132 to which the acoustic signals to be recorded have been transferred records the acoustic data on the basis of the string ID number and the recording ID number given to the acoustic signals. In principle, the recording ID number corresponds to a table row where no recording has been made. The acoustic signals of a plurality of strings transferred at the same time are recorded as acoustic data in the same table row.

The recording unit 132 may be configured to be capable of overwrite recording that overwrites part of a table row in which a recording has already been performed. With such a configuration, it is possible to correct the recorded content when a mistake during performance or the like occurs.

Upon completion of the recording, the acoustic device 100 ends the recording operation (Step S103). Note that different recording operations may be started before one recording operation is completed, in which case a plurality of recording operations operate in parallel.

Next, an operation of the acoustic device 100 when a reverse effect is imparted will be described. The reverse effect is a sound effect that converts an acoustic signal into a reverse playback acoustic signal in which the time advances in the opposite direction.

Figure 4:
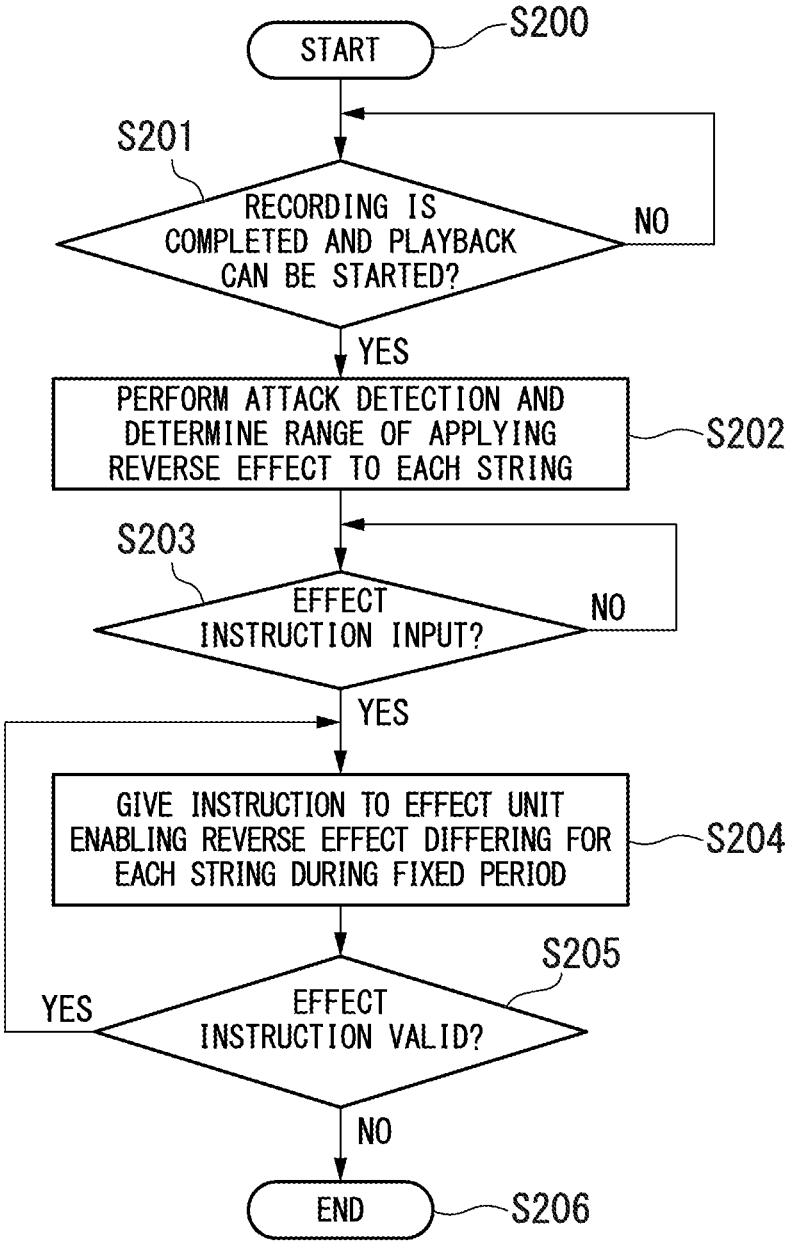
FIG. 4 is a flowchart for describing the operation of the acoustic device shown in FIG. 1 in which an effect instruction is given in which the acoustic effect is a reverse effect.

FIG. 4 is a flowchart for describing the operation of the acoustic device 100 when there is an effect instruction, in which the acoustic effect is the reverse effect, after the recording instruction. The subsequent operations will be described with reference to the flowchart shown in FIG. 4.

When the recording of at least one acoustic data has been started, the acoustic device 100 enters a playback standby state (Step S200). In the operation of the acoustic device 100 shown in this flowchart, when the recording by the recording unit 132 is completed, the control unit 12 causes the string acoustic signal playback unit 133 to start loop playback of the recorded acoustic data. That is, even if the player does not operate the operation input unit 11 to perform a playback instruction, playback of the acoustic data is automatically started after the recording is completed (Step S201). By operating the acoustic device 100 in this way, it is possible to easily create an acoustic signal for immediately playing back in a loop short acoustic data that has been recorded.

When the recording by the recording unit 132 is completed, the control unit 12 instructs the analysis unit 14 to analyze the recorded acoustic data (Step S202). In this example, in the recording operation in Step S201, the two strings of the first string and the second string are to be recorded. For this reason, the control unit 12 instructs the analysis unit 14 to detect attacks on these two strings.

Since the acoustic data recorded in the recording unit 132 is recorded for each string ID number, acoustic data of a specific string can be specified. In addition, among the acoustic data recorded in the recording unit 132, items of acoustic data recorded simultaneously have the same recording ID number, and so the analysis unit 14 can specify the acoustic data recorded simultaneously.

Figure 5:
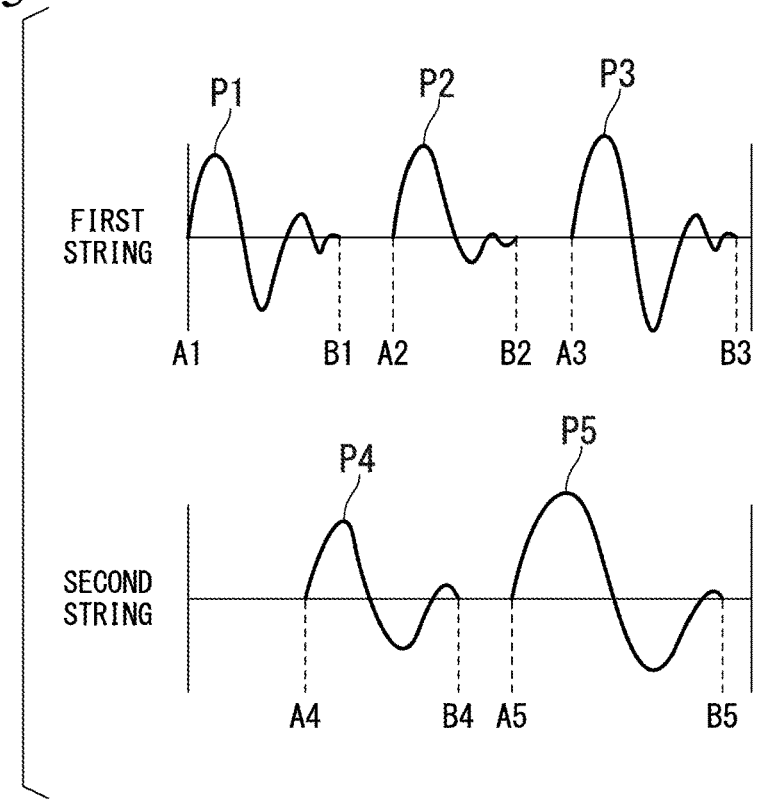
FIG. 5 is an acoustic signal before the reverse effect is imparted by the effect unit of the acoustic device shown in FIG. 1.

FIG. 5 shows the acoustic signals of the first and second strings recorded simultaneously by the recording unit 132. The analysis unit 14 analyzes dividable phrase areas in each acoustic signal (hereinafter, referred to as "phrase areas") by performing attack detection.

For example, in the acoustic signal of the first string shown in FIG. 5, three types of dividable phrase areas are detected, that is, a phrase P1 (A1 to B1), a phrase P2 (A2 to B2), and a phrase P3 (A3 to B3).

For example, in the acoustic signal of the second string shown in FIG. 5, two types of dividable phrase areas are detected, that is, a phrase P4 (A4 to B4) and a phrase P5 (A5 to B5).

Next, the acoustic device 100 waits for an effect instruction to be input to the operation input unit 11 (Step S203). When the player inputs to the operation input unit 11 an effect instruction in which the acoustic effect is a reverse effect, the control unit 12 instructs the effect unit 15 to impart a reverse effect (Step S204).

Even if the player does not operate the operation input unit 11 to give an effect instruction, playback is started, and after a lapse of a predetermined time, for example, after playback (loop playback) of the recorded acoustic signal is repeated four times, the effect unit 15 may automatically start imparting an acoustic effect.

The effect unit 15, upon receiving an instruction to impart the reverse effect, selects one of the dividable phrase areas analyzed by the analysis unit 14 and imparts the reverse effect to the selected phrase area. The selection of the phrase area to which the reverse effect is imparted may for example be performed randomly, or the phrase area having the largest peak value may be selected.

Figure 6:
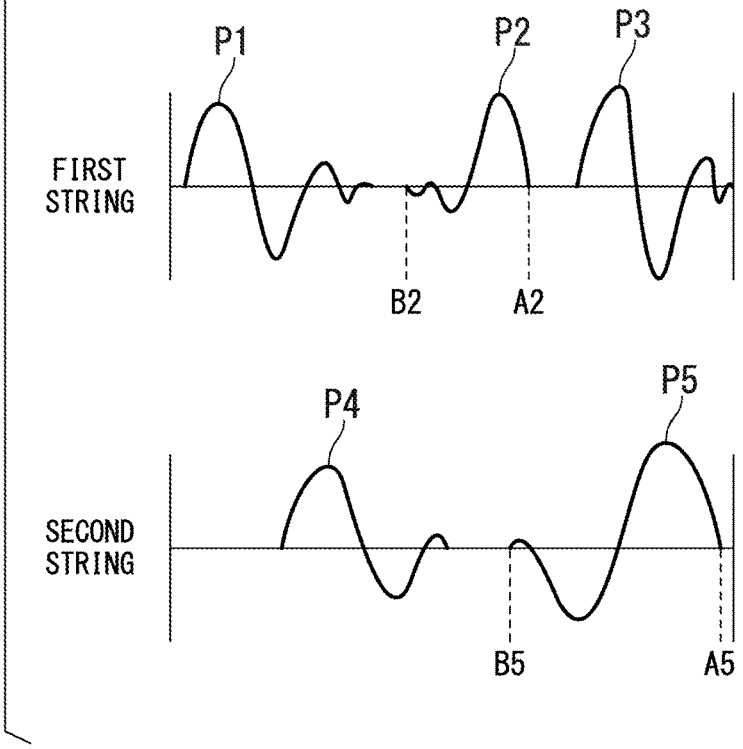
FIG. 6 is an acoustic signal after the reverse effect has been imparted by the effect unit of the acoustic device shown in FIG. 1.

FIG. 6 shows the acoustic signal after the reverse effect is imparted to the acoustic signal shown in FIG. 5. In the acoustic signal of the first string shown in FIG. 5, the phrase P2 (A2 to B2) is converted into a reverse playback acoustic signal in which the time advances in the opposite direction. In the acoustic signal of the second string shown in FIG. 6, the phrase P5 (A5 to B5) is converted into a reverse playback acoustic signal in which the time advances in the opposite direction.

Since a different reverse effect is imparted to each string, a complicated reverse effect can be obtained. In addition, since the reverse effect is imparted for each string, the chord consistency can be maintained even after the reverse effect is imparted.

Such attack detection and the imparting of the reverse effect cannot be easily performed by real-time processing of an acoustic signal, and so are remarkable features unique to the acoustic device 100, which performs analysis of recorded acoustic data by non-real-time processing.

After a predetermined time has elapsed from the start of the imparting of the acoustic effect, for example after playback (loop playback) of the recorded acoustic signal is repeated twice, confirmation is performed whether the effect instruction is still valid (Step S205). When an effect instruction has not been input from the operation input unit 11, imparting of the acoustic effect ends (Step S206). When an effect instruction is subsequently input from the operation input unit 11, Step S204 is executed again.

When Step S204 is executed again, the effect unit 15 may change the phrase area to which the reverse effect is imparted. By changing the phrase area to which the reverse effect is imparted for each playback (loop reproduction) of the recorded acoustic signal, it is possible to obtain an acoustic effect resembling an arpeggio performance of a guitar.

Figure 7:
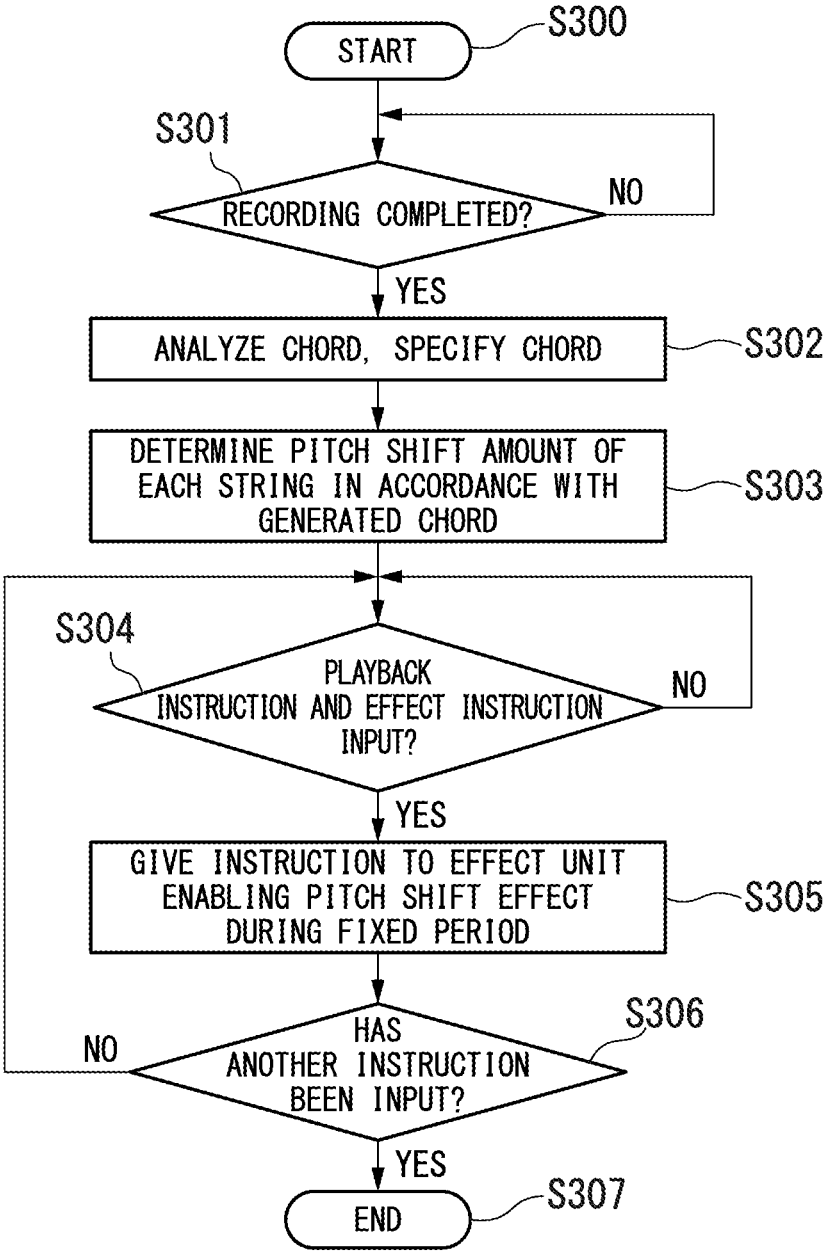
FIG. 7 is a flowchart illustrating the operation of the acoustic device shown in FIG. 1 when an effect instruction is given in which the acoustic effect is pitch shift.

Next, the operation of the acoustic device 100 when the pitch shift effect is imparted will be described. FIG. 7 is a flowchart for describing the operation of the acoustic device 100 when, after the recording instruction, there is an effect instruction in which the acoustic effect is a pitch shift effect. The subsequent operation will be described in accordance with the flowchart shown in FIG. 7.

When recording of at least one acoustic data is started, the acoustic device 100 enters a playback standby state (Step S300). In the operation of the acoustic device 100 shown in this flowchart, playback is not started until a playback instruction is input to the operation input unit 11. Here, the player played and recorded only one type of chord, not a phrase.

When the recording by the recording unit 132 is completed (Step S301), the control unit 12 instructs the analysis unit 14 to analyze the chord of the recorded acoustic data and specify the chord (Step S302). In this example, the three strings, that is, the fourth, fifth, and sixth strings are to be recorded in the recording operation in Step S301. Therefore, the control unit 12 instructs chord analysis for these three strings.

The acoustic data recorded in the recording unit 132 is recorded for each string ID number. Therefore, the acoustic data of a specific string can be specified. In the acoustic data recorded in the recording unit 132, items of acoustic data recorded at the same time have the same recording ID number. For this reason, the analysis unit 14 can specify acoustic data recorded at the same time. Therefore, the analysis unit 14 can specify the chord from the recorded sound data.

Figure 8:
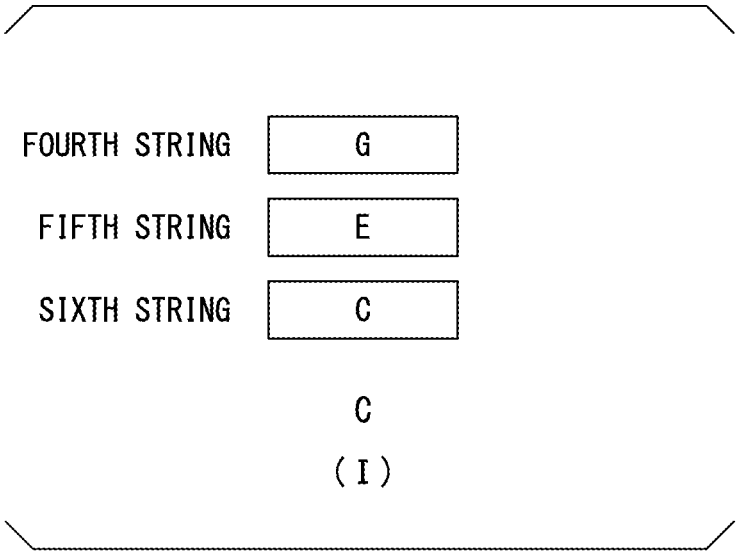
FIG. 8 is a chord analysis result before the pitch shift effect is imparted by the effect unit of the acoustic device shown in FIG. 1.

Next, the analysis unit 14 determines the pitch shift amount for each string when changing the chord from the specified chord (Step S303). FIG. 8 shows the result of chord analysis for three strings, that is, the fourth, fifth, and sixth strings.

As shown in FIG. 8, the recorded acoustic data is "G" for the 4th string, "E" for the 5th string, and "C" for the 6th string, and so the analyzed chord is "C". The analysis unit 14 determines the pitch shift amount for each string when changing the chord from the "C" chord to another chord (hereinafter, referred to as a "generated chord"). Here, the generated chord is a "Dm" chord, which is the second minor chord (IIm) when the "C" chord is the root chord (I).

Figure 9:
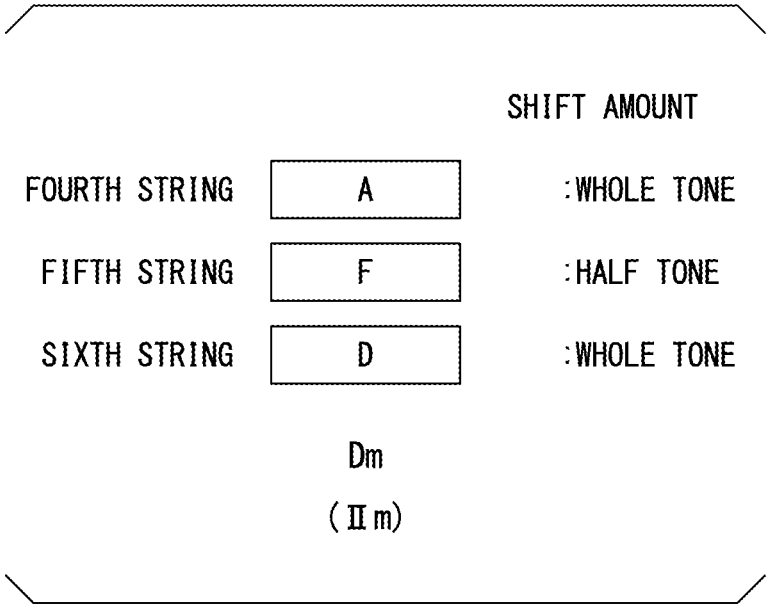
FIG. 9 is a chord analysis result after the pitch shift effect is imparted by the effect unit of the acoustic device shown in FIG. 1.

FIG. 9 shows the pitch shift amounts for the three strings of the fourth, fifth, and sixth strings. As shown in FIG. 9, the determined pitch shift amount is a whole tone shift from "G" to "A" for the fourth string, a half-tone shift from "E" to "F" for the fifth string, and a whole tone shift from "C" to "D" for the sixth string.

The pitch shift amount can be changed for each string. Therefore, for example, a chord change that cannot be performed when the same pitch shift is performed on all six strings, such as a chord change from a major chord to a minor chord, can be performed.

Similarly, the analysis unit 14 determines the pitch shift amount for each string when the generated chord is another chord frequently used in a chord progression (for example, IV, V, or the like). Here, the chord progression may be selected from those frequently occurring in the genre of music played by the player, or may be directly specified by the player.

Next, the acoustic device 100 waits for a playback instruction and an effect instruction to be input to the operation input unit 11 (Step S304). A case will be described in which the player inputs an effect instruction whose acoustic effect is a pitch shift together with a playback instruction to the operation input unit. In this case, the control unit 12 instructs the string acoustic signal playback unit 133 to play back the acoustic data to be played back, and also instructs the effect unit 15 to impart the pitch shift effect (Step S305). The playback instruction here is an instruction to play back the recorded acoustic data only once.

Here, the player, in addition to specifying an effect instruction in which the acoustic effect is a pitch shift, specifies the chord (for example, IIm, IV, V, etc.) to be generated by pitch shifting. Here, it will be assumed that IIm is specified as the generated chord.

The string acoustic signal playback unit 133 plays back acoustic data to be played back. The effect unit 15 imparts a pitch shift effect based on the pitch shift amount determined for each string on the basis of the generated chord that has been specified. As a result, the acoustic signal of "Dm", which is the generated chord shown in FIG. 9, is output from the effect unit 15.

Such chord analysis and the imparting of the pitch shift effect for each string cannot be easily performed by real-time processing of an acoustic signal, and so are remarkable features unique to the acoustic device 100, which performs analysis of recorded acoustic data by non-real-time processing.

After playing back the acoustic data to be played back, it is confirmed whether or not another instruction such as a recording instruction or another effect instruction has been input from the operation input unit 11 (Step S306). If another instruction has been input from the operation input unit 11, the imparting of the sound effect of the pitch shift effect ends (Step S307). If another instruction has not been input from the operation input unit 11, Step S304 is executed again.

In Step S304 that is executed again, the player inputs, to the operation input unit 11, an effect instruction whose acoustic effect is a pitch shift together with a playback instruction. By specifying a generated chord different from the previously specified generated chord as the generated chord specified at this time, it is possible to generate and play multiple chords from one recorded chord, and perform loop playback accompanying a chord progression. According to the acoustic device 100 of the present embodiment configured as described above, the acoustic signal of the strings 210 can be recorded and played back for each string, and it is possible to perform analysis of acoustic signals for each string by non-real-time processing by the analysis unit 14 in addition to real-time processing. Using the analysis result, it is possible to impart a reverse effect or various acoustic effects that differ for each string.

The acoustic device 100 in the above-described embodiment may be implemented by a computer. In that case, a program for implementing this function may be recorded on a computer-readable recording medium, and the program recorded on this recording medium may be read and executed by a computer system so as to implement it. "Computer system" herein includes an OS and hardware such as peripheral devices. A "computer-readable recording medium" refers to portable media such as a flexible disk, a magneto-optical disk, a ROM, and a CD-ROM, as well as a storage device such as a hard disk integrated into a computer system. Moreover, a "computer-readable recording medium" refers to a communication line for transmitting a program via a network such as the Internet or a communication line such as a telephone line, and dynamically holds the program for a short time. Such a program may include a program that holds a program for a certain period of time, such as a volatile memory in a computer system serving as a server or a client in that case. The program may be for implementing some of the functions described above, or may be a program that can implement the above-mentioned functions in combination with a program already recorded in a computer system, and may be implemented using a programmable logic device such as a field programmable gate array (FPGA) or the like.

Although an embodiment of the present invention has been described in detail with reference to the drawings, the specific configuration is not limited to this embodiment, and may include design changes and the like within a scope not departing from the gist of the present invention. The constituent elements shown in the above-described embodiment and the modifications described below can be appropriately combined and configured. For example, in the above embodiment, the stringed instrument to which the acoustic device 100 is connected is an electric guitar 200 having six strings, but the stringed instrument to which the acoustic device 100 is connected is not limited to the electric guitar 200. The stringed instrument to which the acoustic device 100 is connected may be a bass guitar having four strings.

For example, in the above embodiment, the acoustic signal recorded in the recording unit 132 is the acoustic signal transferred from the string acoustic signal write unit 131, but the acoustic signal recorded in the recording unit 132 is not limited thereto. The recording unit 132 may be configured to be able to record the acoustic signal output from the effect unit 15 (resampling). By recording an acoustic signal to which an acoustic effect has been imparted, it is possible to again impart an acoustic effect to that acoustic signal.

In the operation of the acoustic device 100 shown in the flowchart of FIG. 7, the effect instruction is the pitch shift effect, but the acoustic effect is not limited to the pitch shift effect. The acoustic effect may be a delay effect in which the delay time differs for each string, or a mute effect for muting the acoustic signal of each string. In any case, it is possible to impart an acoustic effect that differs for each string, and so an acoustic effect resembling an arpeggio performance of a guitar can be obtained.

According to an embodiment of the present invention, a string acoustic signal can be recorded and played back for each string, and it is possible to analyze the string acoustic signal and impart an acoustic effect to the string acoustic signal by non-real-time processing.

The present invention may be applied to an acoustic device and an acoustic control program. The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An acoustic device comprising:

at least one memory configured to store instructions;

at least one processor configured to execute the instructions to:

record string independent acoustic signals in a first period, the string independent acoustic signals in the first period respectively corresponding to different strings of a stringed instrument and being independent from each other, the strings including a first string and a second string, the string independent acoustic signals in the first period including a string independent acoustic signal in the first period that corresponds to the first string and a string independent acoustic signal in the first period that corresponds to the second string;

analyze at least the string independent acoustic signal in the first period that corresponds to the first string from among the recorded string independent acoustic signals in the first period;

impart an acoustic effect to the string independent acoustic signal in the first period that corresponds to the first string, based on a result of the analysis;

newly acquire a string independent acoustic signal in a second period that corresponds to the first string and a string independent acoustic signal in the second period that corresponds to the second string, the second period being different from the first period; and generate an acoustic signal including: a signal based on the string independent acoustic signal in the first period that corresponds to the first string and to which the acoustic effect has been imparted; and a signal based on the string independent acoustic signal in the second period that corresponds to the second string.

2. The acoustic device according to claim 1, wherein the acoustic effect includes a reverse effect of converting the string independent acoustic signal in the first period that corresponds to the first string into a reverse playback acoustic signal.

3. The acoustic device according to claim 2, wherein the at least one processor is configured to execute the instructions to, based on the result of the analysis, determine an area of the string independent acoustic signal in the first period that corresponds to the first string and to which the reverse effect is imparted.

4. The acoustic device according to claim 1, wherein the acoustic effect includes a pitch shift effect.

5. The acoustic device according to claim 4, wherein the strings further include a third string and a fourth string, the string independent acoustic signals in the first period further includes a sting independent acoustic signal in the first period that corresponds to the third string and a string independent acoustic signal in the first period that corresponds to the fourth string, the at least one processor is configured to execute the instructions to analyze a chord from the string independent acoustic signal in the first period that corresponds to the first string, the string independent acoustic signal in the first period that corresponds to the third string, and the string independent acoustic signal in the first period that corresponds to the fourth string, and determine a pitch shift amount of each of the string independent acoustic signal in the first period that corresponds to the first string, the sting independent acoustic signal in the first period that corresponds to the third string, and the string independent acoustic signal in the first period that corresponds to the fourth string, based on a result of the chord analysis.

6. The acoustic device according to claim 1, wherein the acoustic effect includes a delay effect that imparts a delay time to the string independent acoustic signal in the first period that corresponds the first string.

7. The acoustic device according to claim 1, wherein the acoustic effect includes a mute effect that mutes the string independent acoustic signal in the first period that corresponds the first string.

8. The acoustic device according to claim 1, wherein the at least one processor is configured to execute the instructions to output the generated acoustic signal.

9. The acoustic device according to claim 1, wherein the strings further include third string, the string independent acoustic signals in the first period further includes the string independent acoustic signal in the first period that corresponds to the third string, the at least one processor is configured to execute the instructions to, based on the result of the analysis, imparts an acoustic effect differing between the string independent acoustic signal in the first period that corresponds to the first string and the string independent acoustic signal in the first period that corresponds to the third string.

10. A non-transitory computer readable recording medium storing an acoustic control program for causing a computer to execute:

recording string independent acoustic signals in a first period, the string independent acoustic signals in the first period respectively corresponding to different strings of a stringed instrument and being independent from each other, the strings including a first string and a second string, the string independent acoustic signals in the first period including a string independent acoustic signal in the first period that corresponds to the first string and a string independent acoustic signal in the first period that corresponds to the second string;

analyzing at least the string independent acoustic signal in the first period that corresponds to the first string from among the recorded string independent acoustic signals in the first period;

imparting an acoustic effect to the string independent acoustic signal in the first period that corresponds to the first string, based on a result of the analysis;

newly acquiring a string independent acoustic signal in a second period that corresponds to the first string and a string independent acoustic signal in the second period that corresponds to the second string, the second period being different from the first period; and generating an acoustic signal including: a signal based on the string independent acoustic signal in the first period that corresponds to the first string and to which the acoustic effect has been imparted; and a signal based on the string independent acoustic signal in the second period that corresponds to the second string.

11. An acoustic control method comprising:

recording string independent acoustic signals in a first period, the string independent acoustic signals in the first period respectively corresponding to different strings of a stringed instrument and being independent from each other, the strings including a first string and a second string, the string independent acoustic signals in the first period including a string independent acoustic signal in the first period that corresponds to the first string and a string independent acoustic signal in the first period that corresponds to the second string;

analyzing at least the string independent acoustic signal in the first period that corresponds to the first string from among the recorded string independent acoustic signals in the first period;

imparting an acoustic effect to the string independent acoustic signal in the first period that corresponds to the first string, based on a result of the analysis;

newly acquiring a string independent acoustic signal in a second period that corresponds to the first string and a string independent acoustic signal in the second period that corresponds to the second string, the second period being different from the first period; and generating an acoustic signal including: a signal based on the string independent acoustic signal in the first period that corresponds to the first sting and to which the acoustic effect has been imparted, and a signal based on the string independent acoustic signal in the second period that corresponds to the second string.

* * * * *